US009895908B2

(12) United States Patent
Kataoka et al.

(10) Patent No.: US 9,895,908 B2
(45) Date of Patent: Feb. 20, 2018

(54) PRINTER

(71) Applicant: TOSHIBA TEC KABUSHIKI KAISHA, Shinagawa-ku, Tokyo (JP)

(72) Inventors: Mitsuhiro Kataoka, Singapore (SG); Dulce Luna, Singapore (SG); Noriyuki Watanabe, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/384,490

(22) Filed: Dec. 20, 2016

(65) Prior Publication Data

US 2017/0182803 A1 Jun. 29, 2017

(30) Foreign Application Priority Data

Dec. 25, 2015 (JP) ..... 2015-254907

(51) Int. Cl.
*B41J 11/66* (2006.01)
*B41J 15/00* (2006.01)

(52) U.S. Cl.
CPC ..... *B41J 11/663* (2013.01); *B41J 15/005* (2013.01)

(58) Field of Classification Search
None
See application file for complete search history.

(56) References Cited

U.S. PATENT DOCUMENTS

2010/0328392 A1* 12/2010 Kanazawa ..... B41J 11/42 347/16

FOREIGN PATENT DOCUMENTS

JP 2010-173822 8/2010

OTHER PUBLICATIONS

Machine Translation of Mukojima, Katsutoshi et al. (JP 2010173822 A), Recording Medium Ejector and Printing Device, Aug. 12, 2010, Citizen Holdings Co LTD (assignee), Paragraphs 0030, 0035-0037, 0046-0050.*

* cited by examiner

*Primary Examiner* — Lisa M Solomon
(74) *Attorney, Agent, or Firm* — Amin, Turocy & Watson LLP

(57) ABSTRACT

A printer comprises a first conveyance section which conveys a sheet; a cutter which cuts the sheet through either full cutting for cutting the whole sheet in a width direction or partial cutting for cutting a part of the sheet in the width direction with remaining part uncut; a second conveyance section which further conveys the sheet conveyed by the first conveyance section towards a discharging port; a housing section which houses a slack part of the sheet generated between the first conveyance section and the second conveyance section due to a conveyance speed difference between the first conveyance section and the second conveyance section; and a controller which changes at least one of the first conveyance section and the second conveyance section in a case in which the cutter cuts the sheet through the full cutting or the partial cutting.

20 Claims, 4 Drawing Sheets

PRINTER

CROSS-REFERENCE TO RELATED APPLICATIONS

This application is based upon and claims the benefit of priority from Japanese Patent Application No. 2015-254907, filed Dec. 25, 2015, the entire contents of which are incorporated herein by reference.

FIELD

Embodiments described herein relate generally to a printer and methods associated therewith.

BACKGROUND

There is known a printer which prints a result of a transaction on a sheet and issues the printed sheet. For example, the printer draws a sheet out from a roll, prints the result of the transaction on the drawn sheet, cuts the drawn sheet and discharges the sheet on which the result of the transaction is printed. For example, the printer includes a loop housing section for housing the sheet before printing and cutting are ended by slackening the sheet in a loop shape.

For example, the printer supports full cutting for cutting the whole of the sheet in a width direction and partial cutting for cutting a part of the sheet in the width direction with remaining part uncut at the time of cutting the sheet in the width direction. The printer can use the partial cutting at the time of printing a coupon, a questionnaire, advertising and the like.

DETAILED DESCRIPTION

In accordance with an embodiment, a printer comprises a first conveyance section, a recording section, a cutter, a second conveyance section, a housing section and a controller. The first conveyance section conveys a sheet towards a discharging port. The recording section records information on the sheet. The cutter cuts the sheet through either full cutting for cutting the whole sheet in a width direction or partial cutting for cutting a part of the sheet in the width direction with remaining part uncut. The second conveyance section further conveys the sheet conveyed by the first conveyance section towards the discharging port. The housing section houses a slack part of the sheet generated between the first conveyance section and the second conveyance section due to a conveyance speed difference towards of the discharging port the first conveyance section and the second conveyance section. The controller changes at least one of the first conveyance section and the second conveyance section in a case in which the cutter cuts the sheet through the full cutting or the partial cutting.

Figure 1:
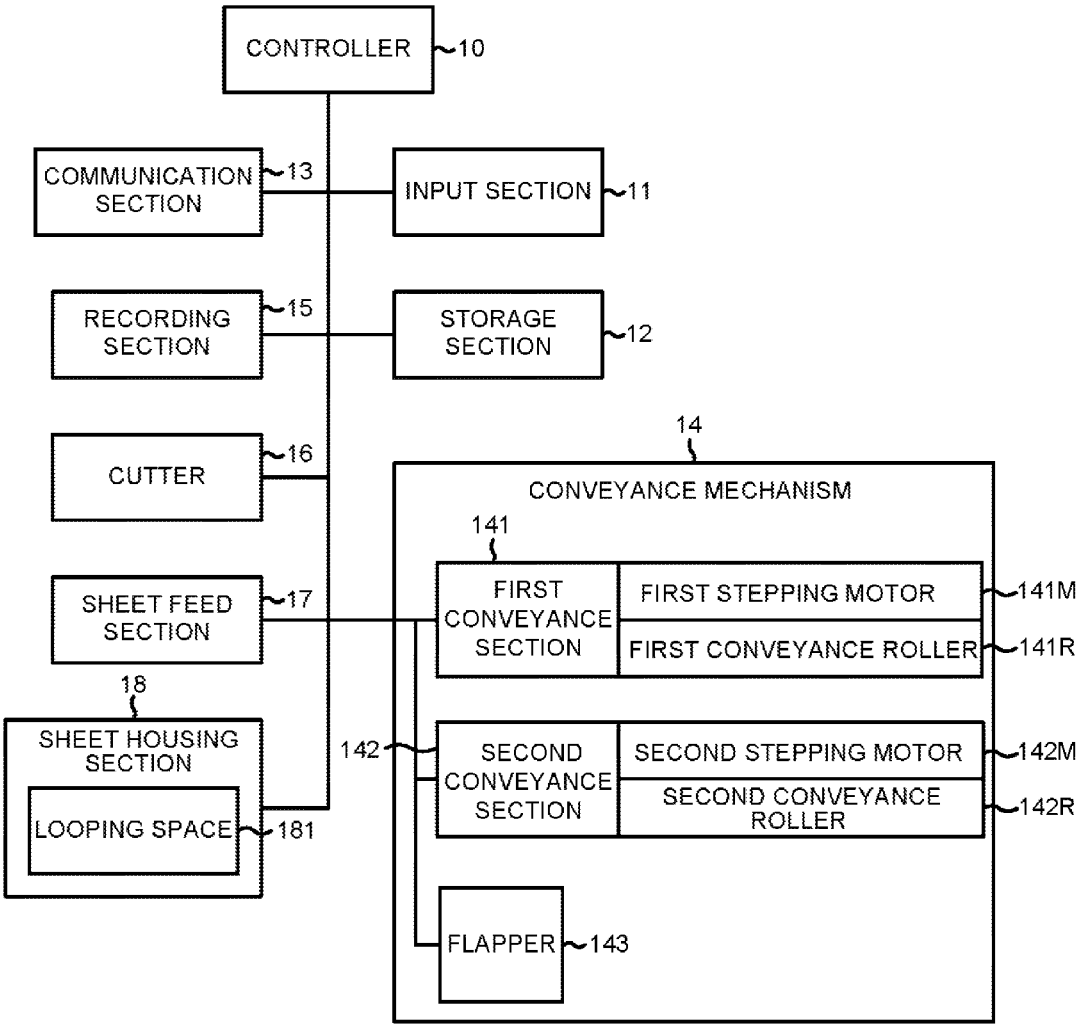
FIG. 1 is a diagram illustrating an example of a printer according to an embodiment.

Hereinafter, the embodiment is described with reference to the accompanying drawings. FIG. 1 is a block diagram illustrating the schematic configuration of a printer 1 according to the embodiment. The printer 1 prints, for example, information such as a result of a transaction on a sheet S which is an image receiving medium and outputs the printed sheet. The printer 1 comprises a controller 10, an input section 11, a storage section 12, a communication section 13, a conveyance mechanism 14, a recording section 15, a cutter 16, a sheet feed section 17, a sheet housing section 18 and a discharging port 19.

The controller 10 includes, for example, a CPU (Central Processing Unit). The controller 10 acts as a computer for controlling each section of the printer 1. The controller 10 controls conveyance of the sheet S, recording of information on the sheet S, and cutting of the sheet S. The input section 11 is, for example, a button type key or a touch panel. The input section 11 receives an input operation by an operator.

The storage section 12 includes a ROM (Read Only Memory) that stores various control programs required for the printer 1 to operate. The storage section 12 includes a RAM (Random Access memory) which is a buffer memory for temporarily storing data generated in the execution of the control program. The storage section 12 includes a non-volatile storage medium for storing various data and programs. The non-volatile storage medium is, for example, an HDD (Hard Disk Drive).

The communication section 13 is, for example, a communication interface. The communication interface is a USB (Universal Serial Bus), a serial port, a parallel port, a LAN (Local Area Network), a WAN (Wide Area Network) and the like. The communication section 13 is connected with an external host computer in a wired or wireless manner. The communication section 13 receives a print job and a command for controlling the printer 1 from the external computer.

The conveyance mechanism 14 includes a first conveyance section 141, a second conveyance section 142 and a flapper 143. The first conveyance section 141 conveys the sheet S towards the discharging port 19 (refer to FIG. 2). The first conveyance section 141 includes a first stepping motor 141M and a first conveyance roller 141R. The first stepping motor 141M normally rotates according to an instruction of normal rotation from the controller 10 and stops the normal rotation according to a stop instruction. The first conveyance roller 141R normally rotates according to the normal rotation of the first stepping motor 141M. The first conveyance roller 141R conveys the sheet S drawn out from a sheet roll housed in the sheet feed section 17 towards the discharging port 19. In the present embodiment, a direction from the sheet feed section 17 to the discharging port 19 is a forward direction.

The second conveyance section 142 further conveys the sheet S conveyed by the first conveyance section 141 towards the discharging port 19. The second conveyance section 142 includes a second stepping motor 142M and a second conveyance roller 142R. The second stepping motor 142M normally rotates according to an instruction of the normal rotation from the controller 10, and stops the normal rotation according to the stop instruction. The second conveyance roller 142R is arranged at the discharging port 19 side with respect to the first conveyance roller 141R. The second conveyance roller 142R normally rotates according to the normal rotation of the second stepping motor 142M. The second conveyance roller 142R conveys the sheet S towards the discharging port 19.

The flapper 143 is arranged between the first conveyance roller 141R and the second conveyance roller 142R. The flapper 143 opens and closes a looping space 181 described later. The flapper 143 rotates to a first position and stops at the first position according to a positioning instruction to the first position from the controller 10. The first position is a position at which a path of the sheet S towards the looping space 181 is closed. In this way, even if the sheet S slackens between the first conveyance roller 141R and the second conveyance roller 142R, the sheet S does not enter the looping space 181.

The flapper 143 rotates to a second position and stops at the second position according to a positioning instruction to the second position from the controller 10. The second position is a position at which the path of the sheet S towards the looping space 181 is opened. In this way, if the sheet S slackens between the first conveyance roller 141R and the second conveyance roller 142R, a slack part of the sheet S enters the looping space 181 through dead weight.

The recording section 15 is arranged between the sheet feed section 17 described later and the first conveyance roller 141R. The recording section 15 records (prints) information based on print data on the sheet S through heat or ink based on a print instruction from the controller 10.

The cutter 16 is arranged between the first conveyance roller 141R and the second conveyance roller 142R. The cutter 16 cuts the sheet S based on a cutting instruction from the controller 10. The cutter 16 cuts the sheet S through full cutting for cutting the whole of the sheet S in a width direction or partial cutting for cutting a part of the sheet S in the width direction with remaining part uncut. The detailed configuration of the cutter 16 is described later.

The sheet feed section 17 holds the sheet roll. The sheet feed section 17 supplies the sheet S drawn out from the sheet roll through the normal rotation of the second conveyance roller 142R and the first conveyance roller 141R to the recording section 15. The sheet housing section (loop presenter) 18 includes the looping space 181. The looping space 181 houses the slack part of the sheet S generated between the first conveyance section 141 and the second conveyance section 142 through a conveyance speed difference towards the discharging port 19 of the first conveyance section 141 and the second conveyance section 142.

Next, a mode in which the full cutting is enabled and a mode in which the partial cutting is enabled which are set in the printer 1 are described. The mode in which the full cutting is enabled is referred to as a first mode. The first mode is a mode for executing the full cutting. The mode in which the partial cutting is enabled is referred to as a second mode. The second mode is a mode for executing the partial cutting.

The printer 1 sets the first mode on the basis that partial cutting declaration is disabled. The printer 1 sets the second mode on the basis that the partial cutting declaration is enabled. The partial cutting declaration is definition for enabling the partial cutting in the printer 1.

The printer 1 stores enabled setting or disabled setting of the partial cutting declaration in the storage section 12. The printer 1 enables the partial cutting declaration based on a partial cutting declaration command transmitted from the host computer via the communication section 13. The partial cutting declaration command is a command relating to the partial cutting declaration and instructs the enabling of the partial cutting declaration. The partial cutting declaration command is a definition command before the print data contained in a print job transmitted from the host computer to the printer 1.

The printer 1 disenables the partial cutting declaration based on a full cutting command transmitted from the host computer via the communication section 13. The full cutting command is a command relating to the full cutting and instructs the full cutting. The full cutting command may be a command different from the print job even if contained in a cutting command for instructing the cutting of the sheet S after the print data contained in the print job.

In a case in which the first mode is set, the cutter 16 cuts the sheet S printed by the recording section 15 through the full cutting. In a case in which the second mode is set, the cutter 16 cuts the sheet S printed by the recording section 15 through the partial cutting.

Furthermore, the printer 1 maintains the second mode even after one print job is terminated in a state in which the second mode is set. In other words, the controller 10 maintains the setting of the second mode until the full cutting command is received after the partial cutting declaration command is received. The controller 10 changes the setting from the first mode to the second mode based on the full cutting command.

Next, a printing processing on the sheet S in the printer 1 is described. The controller 10 carries out different printing processing on the sheet S according to the setting of the first mode or the second mode. For example, The controller 10 changes at least one of the first conveyance section 141 and the second conveyance section 142 in a case in which the cutter 16 cuts the sheet S through the full cutting (first mode) and in a case in which the cutter 16 cuts the sheet S through the partial cutting (second mode).

(Printing Processing on Sheet S in First Mode)

Figure 2:
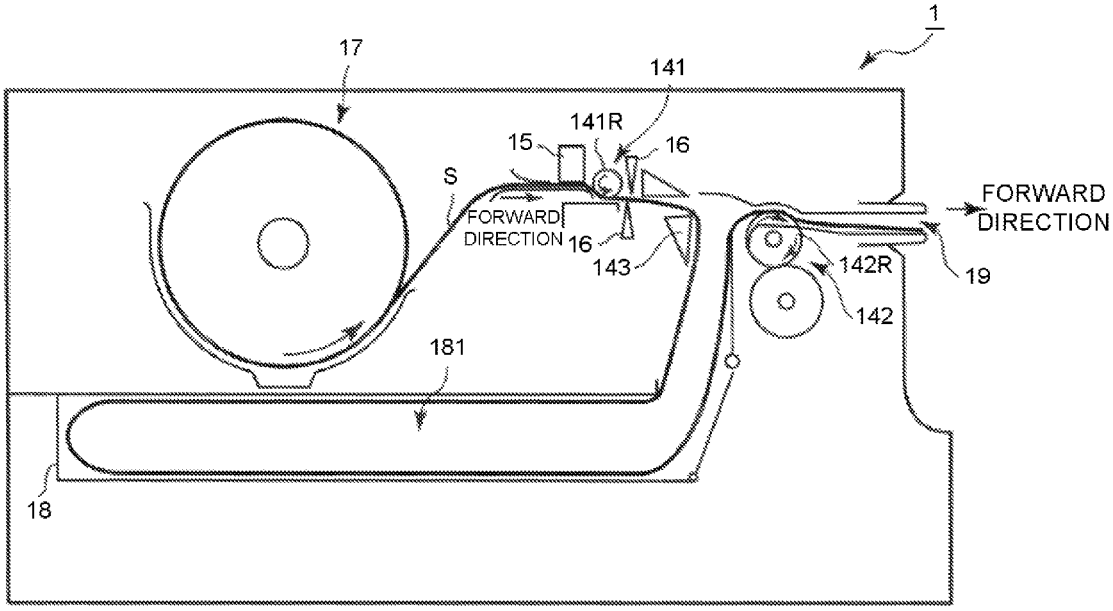
FIG. 2 is a sectional diagram illustrating the schematic configuration of the printer according to the embodiment, and is a diagram illustrating a position of a flapper corresponding to a first mode and an example of conveyance of a sheet.

FIG. 2 is a sectional diagram illustrating the schematic configuration of the printer 1. FIG. 2 is a diagram illustrating the position of the flapper 143 corresponding to the first mode and an example of conveyance of the sheet S. Herein, the printer 1 sets the first mode. Alternatively, the print job received by the printer 1 does not contain the partial cutting declaration command.

The controller 10 controls each section as follows to process the print job in a case in which the first mode is set. The controller 10 controls the flapper 143 to move to the first position at which the sheet housing section 18 is closed. In particular, the controller 10 outputs the positioning instruction to the first position to the flapper 143. The flapper 143 rotates to the first position and stops at the first position according to the positioning instruction to the first position from the controller 10.

The controller 10 drives the first stepping motor 141M until the front end of the sheet S reaches the second conveyance roller 142R. The first conveyance roller 141R normally rotates in accordance with the first stepping motor 141M, and the front end of the sheet S reaches the second conveyance roller 142R. If the front end of the sheet S reaches the second conveyance roller 142R, the controller 10 controls the flapper 143 to move to the second position at which the sheet housing section 18 is opened. In particular, the controller 10 outputs the positioning instruction to the second position to the flapper 143. The flapper 143 rotates to the second position and stops at the second position according to the positioning instruction to the second position from the controller 10. The flapper 143 supplies a path for the sheet S which slackens between the first conveyance roller 141R and the second conveyance roller 142R to enter the looping space 181.

The controller 10 carries out the control to set the conveyance speed of the first conveyance section 141 to a first speed. In particular, the controller 10 outputs an instruction of the normal rotation at the first speed to the first stepping motor 141M. The first conveyance roller 141R normally rotates at the first speed in accordance with the first stepping motor 141M. The controller 10 carries out the control to set the conveyance speed of the second conveyance section 142 to a second speed slower than the first speed or stop the second conveyance section 142. In particular, the controller 10 outputs an instruction of the normal rotation at the second speed or an instruction for stopping the second conveyance section 142 to the second stepping motor 142M. The second conveyance roller 142R normally rotates at the second speed in accordance with the second stepping motor 142M or stops. In other words, the printer 1 almost does not discharge the sheet S from the discharging port 19 in the printing processing.

Due to the generation of the conveyance speed difference between the first conveyance section 141 and the second conveyance section 142, the sheet S (sheet of which the printing is completed) slackens between the first conveyance section 141 and the second conveyance section 142. The looping space 181 houses the slack part of the sheet S (slack part of the loop-shape sheet S) between the first conveyance section 141 and the second conveyance section 142.

The controller 10 carries out the control in such a manner that the recording section 15 records the information on the sheet S based on the print data contained in the print job together with the conveyance control of the sheet S. The recording section 15 records the information based on the print data on the conveyed sheet S.

The controller 10 carries out the control in such a manner that the cutter 16 cuts the sheet S through the full cutting based on the cutting command contained in the print job. In particular, the controller 10 outputs an instruction of the full cutting to the cutter 16. As the printer 1 sets the first mode, the controller 10 outputs the instruction of the full cutting to the cutter 16. The cutter 16 cuts the sheet S through the full cutting based on the instruction of the full cutting. In this way, the front end part of the sheet S is entirely cut from the sheet roll housed in the sheet feed section 17.

The controller 10 outputs an instruction of the normal rotation at a predetermined speed to the second stepping motor 142M so as to discharge the cut sheet from the discharging port 19. The second conveyance section 142 discharges the cut sheet from the discharging port 19. Furthermore, the speed at which the second conveyance section 142 conveys the cut sheet is not particularly limited. Furthermore, the controller 10 may discharge the front end of the cut sheet from the discharging port 19, or may also discharge nearly all the cut sheet in a length direction from the discharging port 19.

(Printing Processing on Sheet S in Second Mode)

Figure 3:
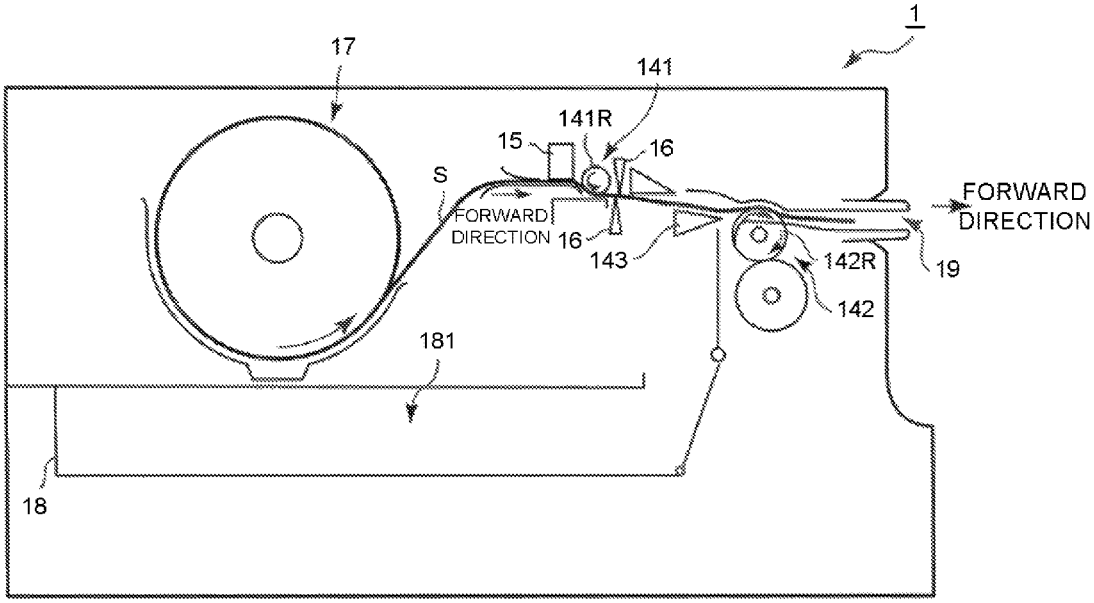
FIG. 3 is a sectional diagram illustrating the schematic configuration of the printer according to the embodiment, and is a diagram illustrating a position of the flapper corresponding to a second mode and an example of conveyance of the sheet.

FIG. 3 is a sectional diagram illustrating the schematic configuration of the printer 1. FIG. 3 is a diagram illustrating the position of the flapper 143 corresponding to the second mode and an example of conveyance of the sheet S. Herein, the printer 1 sets the second mode. Alternatively, the print job received by the printer 1 contains the partial cutting declaration command. In this way, the printer 1 sets the second mode.

The controller 10 controls each section as follows to process the print job in a case in which the second mode is set. The controller 10 controls the flapper 143 to move to the first position at which the sheet housing section 18 is closed. In particular, the controller 10 outputs the positioning instruction to the first position to the flapper 143. The flapper 143 rotates to the first position and stops at the first position according to the positioning instruction to the first position from the controller 10. The flapper 143 blocks the path through which the sheet S slackening between the first conveyance controller 141R and the second conveyance roller 142R enters the looping space 181

The controller 10 carries out the control to set the conveyance speed of the first conveyance section 141 to a third speed slower than the first speed. In particular, the controller 10 outputs an instruction of the normal rotation at the third speed to the first stepping motor 141M. The first conveyance roller 141R normally rotates at the third speed in accordance with the first stepping motor 141M.

The controller 10 carries out the control to set the conveyance speed of the second conveyance section 142 to a fourth speed equal to or slower than the third speed. In particular, the controller 10 outputs an instruction of the normal rotation at the fourth speed to the second stepping motor 142M. The second conveyance roller 142R normally rotates at the fourth speed in accordance with the second stepping motor 142M. In other words, the printer 1 gradually discharges the sheet S from the discharging port 19 in the printing processing.

The controller 10 carries out the control in such a manner that the recording section 15 records the information on the sheet S based on the print data the contained in the print job together with the conveyance control of the sheet S. The recording section 15 records the information based on the print data on the conveyed sheet S.

The controller 10 carries out the control in such a manner that the cutter 16 cuts the sheet S through the partial cutting based on the cutting command contained in the print job. In particular, the controller 10 outputs the instruction of the partial cutting to the cutter 16. As the printer 1 sets the second mode, the controller 10 outputs the instruction of the partial cutting to the cutter 16. The cutter 16 cuts the sheet S through the partial cutting based on the instruction of the partial cutting. In this way, the sheet S is not separated at a front section which locates at a front part with respect to the partial cutting part and a front section through uncut part of the partial cutting part of the sheet S.

The controller 10 maintains the conveyance speed of the first conveyance section 141 at the third speed, maintains the conveyance speed of the second conveyance section 142 at the fourth speed, and discharges the sheet which is partially cut from the discharging port 19. In this way, the printer 1 discharges the sheet S from the front end to a part nearby the partial cutting part the sheet S from the discharging port 19.

The reason why controller 10 sets the conveyance speed of the first conveyance section 141 to the third speed slower than the first speed and sets the conveyance speed of the second conveyance section 142 to the fourth speed equal to or slower than the third speed is described.

There is difference in the conveyance speed between the first conveyance section 141 and the second conveyance section 142 due to design error even if the controller 10 outputs the command of the same conveyance speed thereto. In this case, the speed difference is generated between the conveyance speed of the first conveyance section 141 and the conveyance speed of the second conveyance section 142. The higher the conveyance speed instructed to the first conveyance section 141 and the second conveyance section 142 is, the larger the speed difference due to the design error becomes.

As stated above, the conveyance speed of the first conveyance section 141 and the second conveyance section 142 in the second mode is slower than the conveyance speed in the first mode. Even if the speed difference is generated between the conveyance speed of the first conveyance section 141 and the conveyance speed of the second conveyance section 142 due to the design error, the speed difference is small. Thus, even if there is the partial cutting part of the sheet S between the first conveyance roller 141R and the second conveyance roller 142R, tension is not applied to the partial cutting part. The partial cutting part of the sheet S does not split in the printer 1.

Furthermore, in a case in which the fourth speed of the second conveyance section 142 is smaller than the third speed of the first conveyance section 141, the sheet S between the first conveyance roller 141R and the second conveyance roller 142R bends. The tension is not applied to the sheet S between the first conveyance roller 141R and the second conveyance roller 142R in a case in which the fourth speed of the second conveyance section 142 is equal to the third speed of the first conveyance section 141. Thus, even if there is the partial cutting part of the sheet S between the first conveyance roller 141R and the second conveyance roller 142R, the tension is not applied to the partial cutting part. The partial cutting part of the sheet S does not split during the conveyance of the sheet S in the printer 1.

Figure 4:
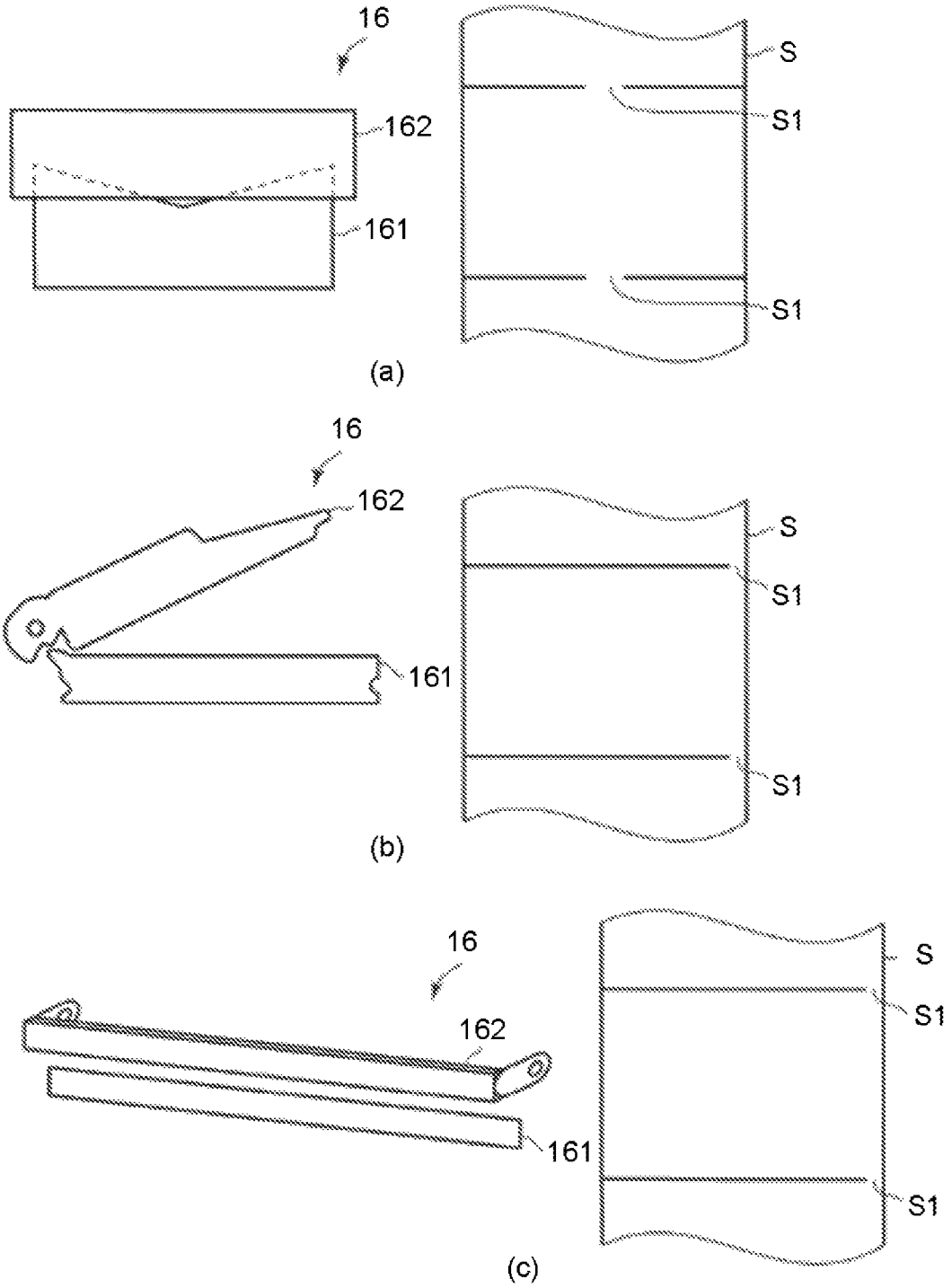
FIG. 4 is a diagram illustrating some examples of cutters according to the embodiment.

FIG. 4 is a diagram illustrating some examples of the cutters 16. The cutter 16 shown in FIG. 4(*a*) includes a first blade 161 and a second blade 162. The shape of a part contacting with the sheet S in the first blade 161 is a shape in which the neighborhood of a central part is recessed with respect to the both ends. The shape of the part contacting with the sheet S in the second blade 162 is a linear shape. The cutter 16 cuts the sheet S through the full cutting or the partial cutting with the first blade 161 and the second blade 162. The recess part of the first blade 161 does not contact with the sheet S, and in this way, the cutter 16 cuts the sheet S through the partial cutting. The recess part of the first blade 161 contacts with the sheet S, and in this way, the cutter 16 cuts the sheet S through the full cutting.

The cutter 16 shown in FIG. 4(*b*) includes a first blade 161 and a second blade 162. The shape of a part contacting with the sheet S in the first blade 161 is a linear shape, and the shape of a part contacting with the sheet S in the second blade 162 is a shape in which a notch is arranged at the end.

The cutter 16 cuts the sheet S through the full cutting or the partial cutting with the first blade 161 and the second blade 162. The notch of the second blade 162 does not contact with the sheet S, and in this way, the cutter 16 cuts the sheet S through the partial cutting. The notch of the second blade 162 contacts with the sheet S, and in this way, the cutter 16 cuts the sheet S through the full cutting.

The cutter 16 shown in FIG. 4(*c*) includes a first blade 161 and a second blade 162. The shape of a part contacting with the sheet S in the first blade 161 is a linear shape, and the shape of a part contacting with the sheet S in the second blade 162 is also a linear shape.

The cutter 16 cuts the sheet S through the full cutting or the partial cutting with the first blade 161 and the second blade 162. The first blade 161 contacts with the whole sheet S in the width direction and the second blade 162 does not contact with the end of the sheet S in the width direction, and in this way, the cutter 16 cuts the sheet S through the partial cutting. The first blade 161 and the second blade 162 contact with the whole sheet S in the width direction, and in this way, the cutter 16 cuts the sheet S through the full cutting.

Figure 5:
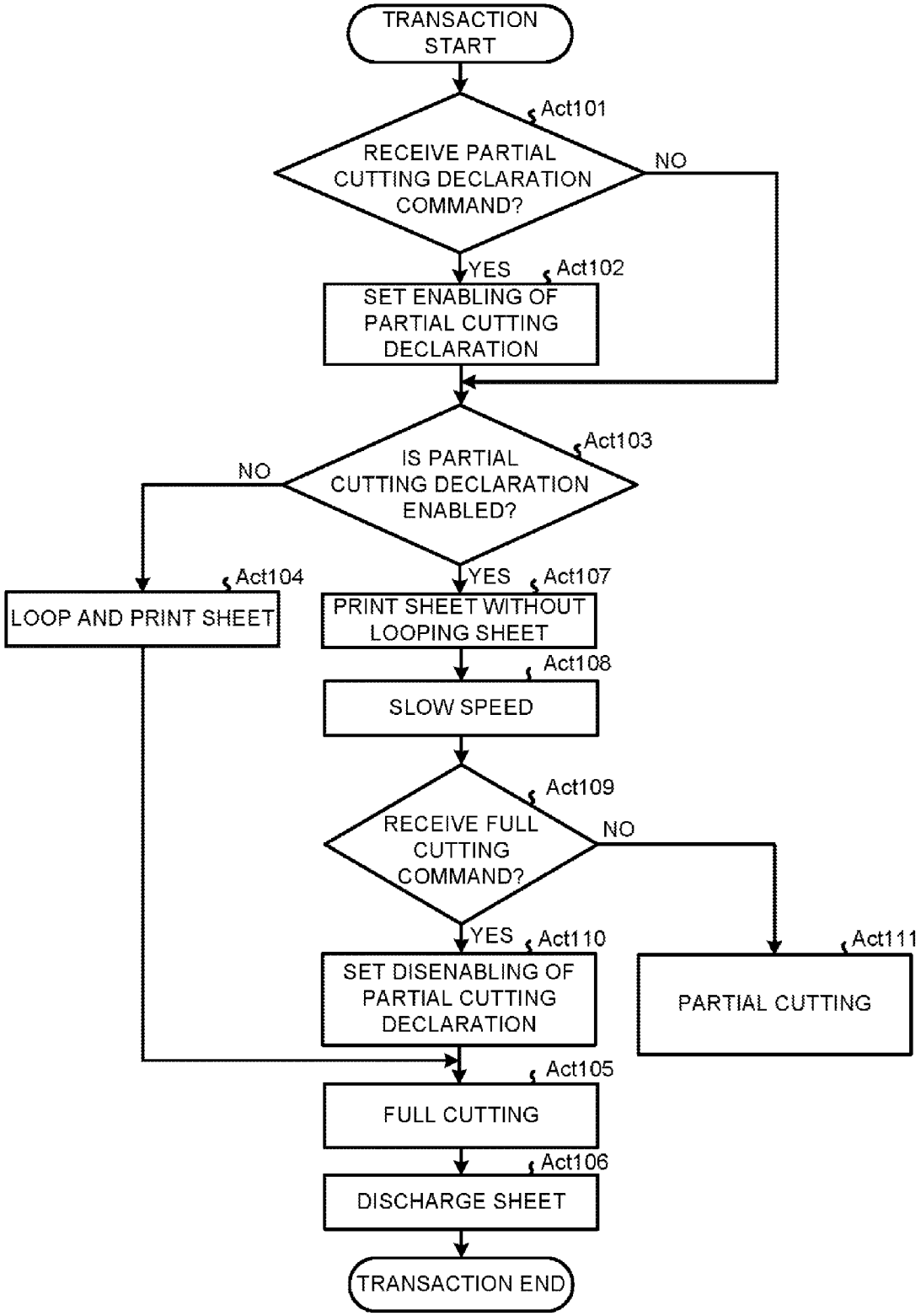
FIG. 5 is a flowchart illustrating an example of a printing processing by the printer according to the embodiment.

FIG. 5 is a flowchart illustrating an example of a printing processing (transaction) by the printer 1 based on one print job. The controller 10 determines whether or not the partial cutting declaration command is received (Act 101). In Act 101, the controller 10 determines whether or not the partial cutting declaration command is contained at the head of the print job.

If the controller 10 determines that the partial cutting declaration command is received (Yes in Act 101), the controller 10 sets the partial cutting declaration to be enabled (Act 102). In Act 102, the controller 10 sets the second mode.

If the controller 10 determines that the partial cutting declaration command is not received (No in Act 101), the controller 10 determines whether or not the partial cutting declaration is enabled (Act 103). In Act 103, the controller 10 determines which one of the first mode and the second mode is set before the print data contained in the print job is processed. The controller 10 receives the partial cutting declaration command in the last print job, and maintains the second mode if the full cutting command after that is not received. Furthermore, the controller 10 may executes the processing in Act 103 after executing the processing in Act 102.

If the partial cutting declaration is not enabled (No in Act 103), the controller 10 carries out the control to loop the sheet S and print the sheet S (Act 104). In Act 104, the controller 10 carries out the control in such a manner that the flapper 143 stops at the second position after the front end of the sheet S reaches the second conveyance roller 142R. The controller 10 carries out the control to convey the sheet S as described in the printing processing on the sheet S in the first mode mentioned above. The controller 10 carries out the control to record the information on the sheet S based on the print data as described in the printing processing on the sheet S in the first mode mentioned above.

The controller 10 carries out the control to cut the sheet S through the full cutting based on the cutting command after the print data contained in the print job (Act 105). In this way, a printed part of the sheet S is entirely cut from the sheet roll housed in the sheet feed section 17. The controller 10 carries out the control to discharge the cut sheet from the discharging port 19 as described in the printing processing on the sheet S in the first mode mentioned above (Act 106).

Return to the processing in Act 103, if the partial cutting declaration is enabled (Yes in Act 103), the controller 10 carries out the control to print the sheet S without looping the sheet S (Act 107). In Act 107, the controller 10 carries out the control in such a manner that the flapper 143 stops at the first position.

The controller 10 carries out the control in such a manner that the print speed in the second mode is slower than that in the first mode (Act 108). In Act 108, the controller 10 carries out the control to convey the sheet S as described in the printing processing on the sheet S in the second mode mentioned above. The controller 10 carries out the control to record the information on the sheet S based on the print data as described in the printing processing on the sheet S in the second mode mentioned above.

The controller 10 determines whether or not the full cutting command is received (Act 109). In Act 109, for example, the controller 10 determines whether or not the cutting command contains the full cutting command. Furthermore, the controller 10 may receive the full cutting command separated from the print job from the host computer.

If the controller 10 receives the full cutting command (Yes in Act 109), the controller 10 sets the disenabling of the partial cutting declaration (Act 110). In Act 110, the controller 10 changes the setting from the second mode to the first mode in response to the reception of the full cutting command in the processing of the print job in the second mode. Then, in Act 105, the controller 10 carries out the control in such a manner that the cutter 16 cuts the sheet S through the full cutting. The controller 10 executes the processing in Act 106 as described above.

If the controller 10 does not receive the full cutting command (No in Act 109), the controller 10 carries out the control in such a manner that the cutter 16 cuts the sheet S through the partial cutting based on the cutting command (Act 111). Furthermore, the controller 10 carries out the control to discharge the sheet S from the discharging port 19 as described in the printing processing on the sheet S in the second mode mentioned above.

In this way, the controller 10 terminates the printing processing of the printer 1 based on one print job. As stated above, the controller 10 sets the second mode in a case in which the partial cutting declaration command is contained in the print job. The controller 10 carries out the control in such a manner that the cutter 16 cuts the sheet S through the partial cutting in the second mode. The controller 10 operates in a mode set at the time the print job is received in a case in which the partial cutting declaration command is not contained in the print job. The controller 10 carries out the control in such a manner that the cutter 16 cuts the sheet S through the full cutting or the partial cutting according to the mode set at the time the print job is received.

Furthermore, the controller 10 maintains the first mode even at the start time of a next print job in a case in which the sheet S is cut through the full cutting in the current print job. Similarly, the controller 10 maintains the second mode even at the start time of a next print job in a case in which the sheet S is cut through the partial cutting in the current print job.

According to the present embodiment, the partial cutting part of the sheet S does not split during the conveyance in the printer 1. The printer 1 can convey the partial cutting part in a steady state towards the discharging port 19 side with respect to the second conveyance roller 142R or the outside of the printer 1. In this way, a user can easily determine which part of the sheet S is the sheet that should be taken away. The risk of jam occurring due to split of the partial cutting part in the printer 1 is reduced.

All the procedures of the processing (each mode) can be executed by software. Therefore, only when the program for executing the procedures of the processing is installed in the printer 1 through a computer-readable storage medium storing the program and is executed, it is possible to easily realize the above processing.

For example, it is possible to read the program from the computer-readable storage medium, store the read program in the storage section 12 and complete the installation of the program via the input section 11. Alternatively, it is possible to download the program, store the downloaded program in the storage section 12 and complete the installation of the program via the communication through section 13. Thus, the controller 10 of the printer 1 can easily realize the above processing based on the installed program described above.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A printer, comprising:

a first conveyance section configured to convey a sheet towards a discharging port;

a recording section configured to record information on the sheet;

a cutter configured to cut the sheet in a width direction either fully or partially with a remaining part uncut;

a second conveyance section configured to further convey the sheet conveyed by the first conveyance section towards the discharging port;

a housing section configured to house a slack part of the sheet generated between the first conveyance section and the second conveyance section due to a conveyance speed difference of the first conveyance section and the second conveyance section; and a controller configured to change a speed of at least one of the first conveyance section and the second conveyance section in a case in which the cutter cuts the sheet fully or partially.

2. The printer according to claim 1, wherein the controller determines which one of a first mode in which full cutting is enabled and a second mode in which partial cutting is enabled is set before print data contained in a print job is processed.

3. The printer according to claim 2, wherein the controller determines whether or not a command relating to the partial cutting is contained in the print job; in a case in which the command relating to the partial cutting is contained in the print job, sets the second mode and carries out control in such a manner that the cutter partially cuts the sheet in the second mode; and in a case in which the command relating to the partial cutting is not contained in the print job, carries out control in such a manner that the cutter fully cuts the sheet or partial cuts in a mode set at the time the print job is received.

4. The printer according to claim 3, wherein the controller maintains setting of the second mode until a command relating to the full cutting is received after the command relating to the partial cutting is received, and changes setting from the second mode to the first mode based on the command relating to the full cutting.

5. The printer according to claim 2, wherein the controller changes the setting from the second mode to the first mode in response to reception of the command relating to the full cutting in the processing of the print job in the second mode, and carries out control in such a manner that the cutter fully cuts the sheet.

6. The printer according to claim 1, wherein the first conveyance section comprises a stepping motor and roller.

7. The printer according to claim 6, wherein the second conveyance section comprises a stepping motor and roller.

8. The printer according to claim 7, wherein the roller of the first conveyance section and the roller of the second conveyance section have different diameters.

9. The printer according to claim 1, wherein the controller is configured to decrease the speed of at least one of the first conveyance section and the second conveyance section.

10. The printer according to claim 2, wherein the speed of at least one of the first conveyance section and the second conveyance section is slower in the second mode compared to the first mode.

11. A printing method, comprising:

conveying a sheet towards a discharging port;

recording information on the sheet;

cutting the sheet in a width direction either fully or partially with a remaining part uncut;

further conveying the sheet towards the discharging port;

housing a slack part of the sheet generated due to a conveyance speed difference of conveying and further conveying; and changing a speed of at least one of the conveying and the further conveying when cutting the sheet fully or partially.

12. The method according to claim 11, further comprising:

determining which one of a first mode in which full cutting is enabled and a second mode in which partial cutting is enabled is set before recording information on the sheet.

13. The method according to claim 12, further comprising:

determining whether or not a command relating to the partial cutting is contained in a print job; in a case in which the command relating to the partial cutting is contained in the print job, setting the second mode and partially cutting the sheet in the second mode; and in a case in which the command relating to the partial cutting is not contained in the print job, fully cutting the sheet or partial cutting in a mode set at the time the print job is received.

14. The method according to claim 13, further comprising:

maintaining setting of the second mode until a command relating to the full cutting is received after the command relating to the partial cutting is received, and changing setting from the second mode to the first mode based on the command relating to the full cutting.

15. The method according to claim 12, wherein changing the setting from the second mode to the first mode in response to reception of the command relating to the full cutting in the processing of the print job in the second mode, and fully cutting the sheet.

16. The method according to claim 11, wherein using a stepping motor and roller to convey the sheet.

17. The method according to claim 16, wherein using a stepping motor and roller to further convey the sheet.

18. The method according to claim 17, wherein the roller of the first conveyance section and the roller of the second conveyance section have different diameters.

19. The method according to claim 11, further comprising:

decreasing the speed of at least one of the conveying and the further conveying.

20. The method according to claim 12, wherein the speed of at least one of the conveying and the further conveying is slower in the second mode compared to the first mode.

* * * * *